US005636486A

United States Patent [19]

Hall

[11] Patent Number: 5,636,486

[45] Date of Patent: Jun. 10, 1997

[54] BRICK TIE

[76] Inventor: John S. Hall, 254 Friel Street, Ottawa, Ontario, Canada, K1N 7V9

[21] Appl. No.: 177,133

[22] Filed: Jan. 4, 1994

[51] Int. Cl.[6] ..... E04B 1/16

[52] U.S. Cl. ..... 52/383; 52/513; 52/508

[58] Field of Search ..... 52/508, 513, 506.06, 52/562, 565, 378, 379, 383, 698, 703, 713

[56] References Cited

U.S. PATENT DOCUMENTS

| | | | |
|---|---|---|---|
| 3,217,457 | 11/1965 | Naar . | |
| 4,182,091 | 1/1980 | Fischer | 52/508 |
| 4,366,651 | 1/1983 | Thomas et al. . | |
| 4,494,347 | 1/1985 | Uhlig | 52/508 |
| 4,545,163 | 10/1985 | Asselin | 52/562 X |
| 4,604,846 | 8/1986 | Ekstrom | 52/508 X |
| 4,998,394 | 3/1991 | Holzapfel et al. . | |
| 5,060,429 | 10/1991 | Pitts et al. | 52/508 X |
| 5,307,602 | 5/1994 | Lebraut | 52/508 X |
| 5,415,510 | 5/1995 | Funaki et al. | 52/508 X |

FOREIGN PATENT DOCUMENTS

| | | | |
|---|---|---|---|
| 2155077 | 9/1985 | United Kingdom | 52/508 |

*Primary Examiner*—Lanna Mai
*Attorney, Agent, or Firm*—Adrian Zahl

[57] ABSTRACT

A masonry tie is provided for engaging a masonry veneer to an underlying support wall. The tie includes a rod and a stud engagement member engageable to the rod. The stud engagement member comprises first and second clamp members that clampingly engage a face plate of the stud. A sealing member may be engaged to the rod to sealingly engage the sheathing of the building wall. The sealing member may include a resilient sleeve encircling the rod that expands radially when compressed axially to grip the hole within the sheathing. A further aspect of the invention includes a tool for the installation of the stud engagement member. The invention further includes a method for installing a tie rod as described above in a retrofit application. The method requires the steps of drilling first, second and third coaxial holes through the brick veneer, sheathing and stud face plate, respectively. The tie rod is inserted through the holes such that the first and second engagement members are positioned on opposite sides of the stud face plate. The engagement members are then drawn towards each other to clampingly engage the face plate. A similar method is employed for new construction applications of the tie.

8 Claims, 6 Drawing Sheets

BRICK TIE

FIELD OF THE INVENTION

The present invention relates to a tie for use in the construction or renovation of masonry walls, to fasten a brick or other masonry veneer to a steel stud backing wall.

BACKGROUND OF THE INVENTION

Masonry walls require the use of a tie to fasten the masonry veneer to an underlying support structure, typically a stud wall. Modern building construction typically employs support walls fabricated from steel studs that support a sheathing of waterproof drywall or the like. With the support of the building residing in the support wall, it is necessary to tie the veneer to the support wall.

A masonry tie generally comprises a metal web or rod fastened at one end to the support structure with the other end being embedded within and engaging the grout or mortar between the bricks. For retrofit applications, an epoxy plug engages the tie to the mortar or grout. It will be understood that the term "rod" used herein refers to any elongate member regardless of cross sectional configuration, including rectangular or cylindrical members.

Several types of ties exist on the market for other retrofit applications and new construction. Conventional ties, such as the Bailey Brick Tie (Tm.) consist of a strip of galvanized steel adapted to be screwed to a steel stud, with a tongue for insertion within the mortar. This type of tie can only be installed during construction of the wall, and cannot easily be used to replace corroded or damaged ties in an existing wall. The Helifix (Tm.) tie is adapted to be installed within a hole of 0.5 inches or less, within an existing wall. However, the tie cannot be used with a steel stud support wall. The Clintek (Tm.) tie is held in place with sacs positioned on either side of each of the studs of the stud wall. However, the use of this tie in retrofit situations requires that a relatively large diameter hole be bored through the masonry, i.e., greater than the typical half inch width of the mortar. As well, the design of the tie renders it prohibitively expensive for most applications.

Existing ties tend to corrode from moisture seepage along the tie. The failure of ties, from corrosion or improper installation, can result in the brick bowing away from the building face and possible failure of the wall. It is desirable to provide a weatherproof seal that limits seepage and entry of air at the exterior drywall sheathing face. As well, it is desirable to provide a tie that can be easily installed in retrofit situations through a relatively small hole in the masonry wall. Ideally, the tie should be capable of installation within a hole of no more than half an inch, to allow it to be positioned entirely or nearly entirely within the mortar. This avoids the requirement of having to patch and color-match the brick after installation. A hole in the mortar is easily plugged with additional mortar material.

OBJECTS OF THE INVENTION

It is an object of the invention to provide a masonry tie capable of use in either new construction or retrofit. For use in retrofit applications, it is an object to provide a tie that is capable of engagement through a hole within the mortar of no more than 0.5 inches. It is a further object to provide a tie adapted for use with a water-resistant seal, to reduce water and air seepage into the support structure. It is a further object of the invention to provide a method for installing a brick tie from the exterior of the building through a hole drilled within the mortar joint of an existing masonry wall.

BRIEF SUMMARY OF THE INVENTION

The invention comprises a masonry tie for engaging a masonry veneer to an underlying support wall, with the support wall having as an element thereof an array of metal support studs. Each of the studs are generally U-shaped, with a front face plate facing the veneer. The tie comprises a rod and a stud engagement member engageable to the rod adapted to extend from the exterior of the wall through a hole within the exterior sheathing of the support wall and an underlying stud. The rod and engagement member are provided with mating threads. The stud engagement member comprises first and second clamp members that clampingly engage the face plate of the stud. The second clamp member incorporates expansion means which expands as the clamp members are drawn together from a closed position whereby the rod may be inserted through the hole within the support wall, radially outwardly to an open position to prevent withdrawal back through the hole. Teeth are provided as well on the second clamp to prevent it from rotating relative to the wall while the rod is rotated to draw the clamp members together. The engagement member may comprise an elongate member adapted to be inserted partway through the face plate, with the first clamp member comprising a plate positionable against an outside face of the stud face plate and the second clamp member having a slotted tubular wall that radiates outwardly when collapsed by axial compression thereof, to engage an inside face of the stud face plate. A sealing member may be engaged to the rod to sealingly engage the sheathing or other component of the building wall. The sealing member may comprise a resilient sleeve encircling the rod that expands radially when compressed axially. The sealing member is adapted to be positioned within and grip the hole within the sheathing. A portion of the resilient sleeve remains outside the hole, and forms an o-ring at the sheathing face when the sleeve is placed under compression, in order to provide the seal.

A further aspect of the invention comprises a tool for the installation of the stud engagement member, having a shaft slideably engaged within a shaft housing. A first end of the shaft engages the second clamp member, and the housing abuts the face of the stud wall. As the shaft is drawn into the housing, it draws the second clamp member towards the first clamp member, to cause the clamp members to fixedly engage the stud wall.

The invention further comprises a method for installing a tie rod as described above in a retrofit application. The method requires the steps of drilling first, second and third coaxial holes through the brick veneer, sheathing and stud face plate, respectively. The holes may be bored by a drill bit having a forward portion narrower than its rearward portion. The tie rod is inserted through said holes such that the first and second engagement members are positioned on opposite sides of the stud face plate. The engagement members are then drawn towards each other to clampingly engage the face plate. The tie rod may be sealed to the sheathing by engaging a sealing member as described above to the sheathing.

A further aspect of the invention is a method for the installation of the tie in a new construction application. This method is similar to the method outlined above, with the omission of the step of boring a hole through the veneer. The holes through the stud face plate and the sheathing are bored prior to the assembly of the veneer, as is the engagement of the tie to the support wall. The masonry veneer is then constructed about the support wall and tie assembly.

BRIEF DESCRIPTION OF THE DRAWINGS

FIG. 3(*b*) is a sectional view, along line A—A in FIG. 3(*b*), showing a portion of the tie;

FIG. 4(*b*) is a rear elevational view of the tie, showing the stud engagement member engaged thereto;

DETAILED DESCRIPTION OF THE PREFERRED EMBODIMENTS

Figure 1:
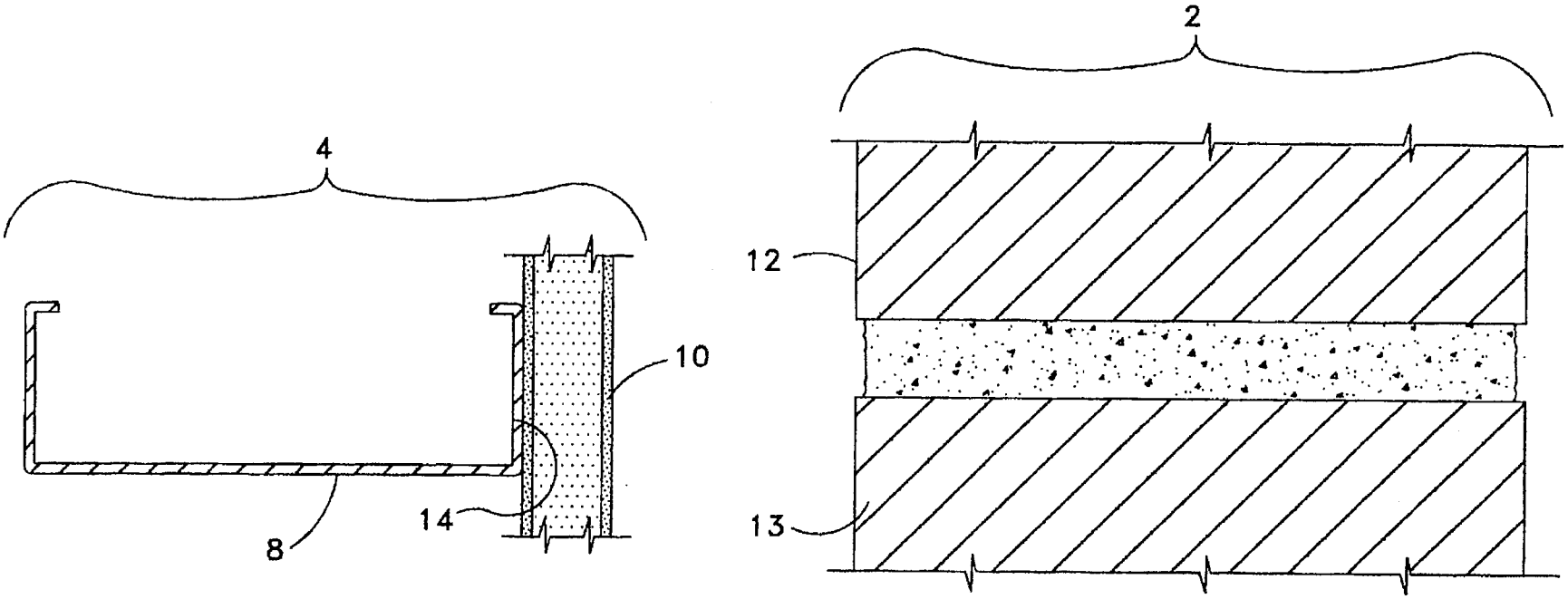
FIG. 1 is a plan view, in section, of a typical masonry veneer wall.

A typical masonry veneer wall, as shown in FIG. 1, is comprised of a masonry veneer 2 separated from a support wall 4 by a gap 6. The support wall 4 is comprised of an array of metal studs 8 that support a water-resistant sheathing 10, which is generally drywall, but may consist of foam sheeting or other sheathing material. The masonry veneer consists of bricks 12 spaced apart by about 0.5" and having mortar 13 in the interstices. The studs comprise a generally U-shaped steel sheet, as seen in section, and have a front plate 14 facing the sheathing 10.

Figure 2:
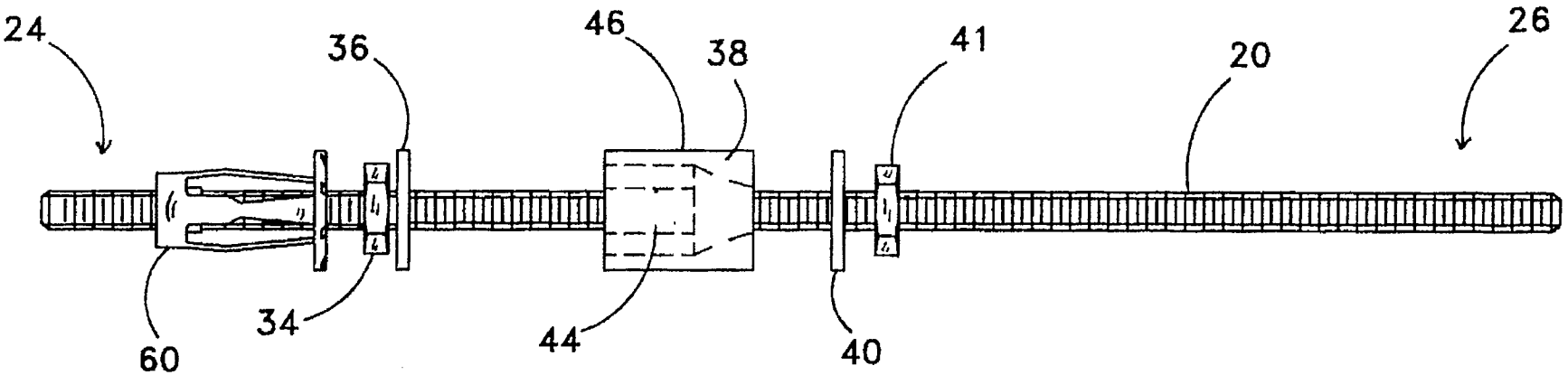
FIG. 2 is an elevational view of a masonry tie according to the present invention.

Referring to FIG. 2, an elongate threaded rod 20 extends the length of the tie, having front and rear portions 24 and 26 facing towards and away from the interior of the building, when installed, respectively. For use with a typical wall structure having a 3.5" thick brick veneer, the rod is about seven inches long.

Prior to installation of the device, the elements positioned on the rod 20 are, in order from front to rear (as shown from left to right in FIG. 2), a rotatable nut 34, a first washer 36 having a generally flat face normal to the axis of the rod, a sealing member 38, a second washer 40, and a fixed nut 41 fixedly engaged to the rod 20. The sealing member 38 comprises a rigid inner sleeve 44 and a resilient exterior sleeve 46 that overhangs the inner sleeve.

The term "sleeve" used herein includes any configuration of an element having a bore therethrough, for example oblong or spherical members.

Figure 3A:
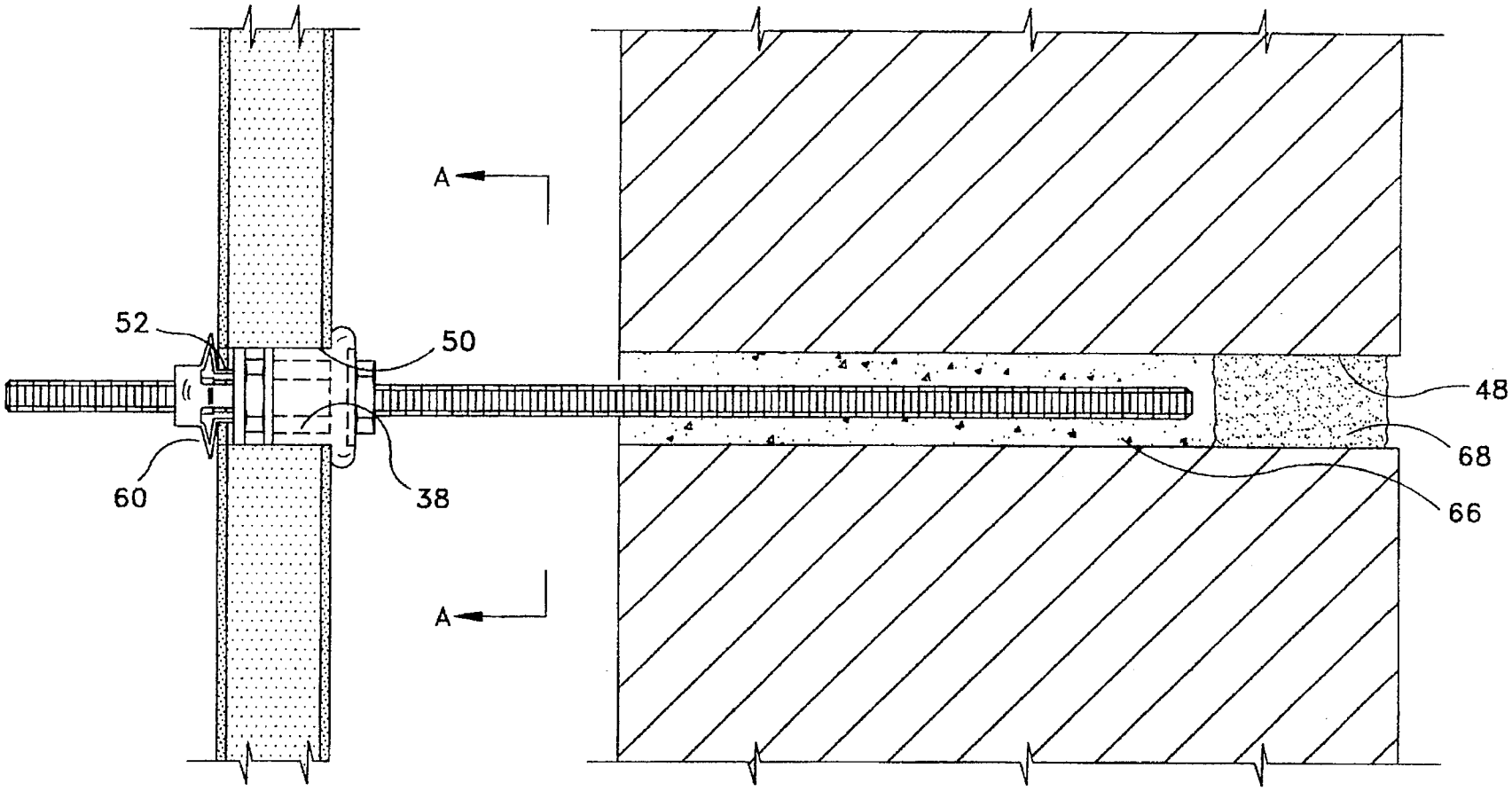
FIG. 3(*a*) is a side elevational view, partly in section, showing the device installed in a masonry wall.
Figure 6:
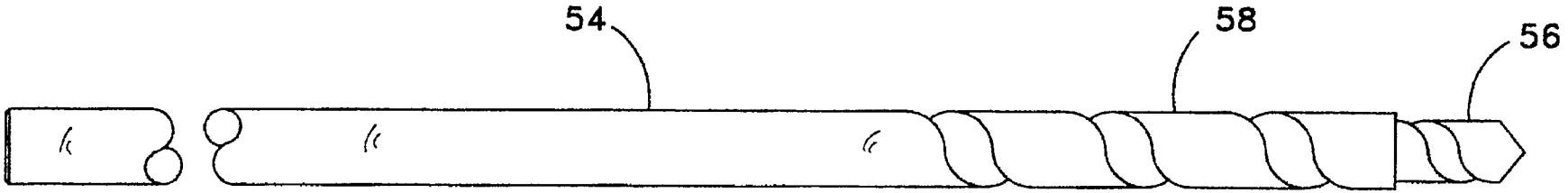
FIG. 6 is an elevational view of a drill bit adapted for installation of the device.
Figure 3B:
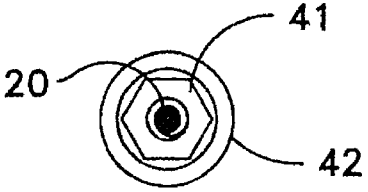

The tie may be installed in either an existing masonry wall, for example in retrofit applications, or in the course of construction of the wall. For retrofit applications, the tie is installed from the outside of the building. Referring to FIG. 3, installation of the device in a retrofit application requires that holes 48, 50 and 52 be bored through the mortar, sheathing and stud, respectively. The holes 48, 50 and 52 are coaxial, with hole 52 having a smaller diameter than holes 48 and 50. The holes may be bored with a drill bit 54, shown in FIG. 7, having a forward portion 56 smaller in diameter than the rearward portion 58. Thus, all three holes 48, 50 and 52 may be bored in a single drilling operation. The larger diameter holes 48 and 50 need be no larger than about 0.5", i.e., the approximate thickness of the mortar layer 13 between the bricks. Thus, damage to the brick veneer is minimized during installation of the device.

For installation in a new construction application, the tie is engaged to the support wall prior to construction of the masonry veneer. The installation process is essentially the same as for a retrofit application, except that the step of boring a hole through the masonry veneer is omitted. As well, the separate boring of the hole through the stud may be replaced by the use of a self-tapping tie, not shown. In this variant, a reamer may mounted to the fastener wrench, discussed below, to countersink the hole 50 within the sheathing prior to engagement of the tie. After assembly of an array of ties to the support wall, the masonry veneer is constructed. The positioning of the ties is arranged such that the ties fit within the interstices between the brick. The mortar surrounding the ties serves to fixedly engage the ties to the veneer, and replaces the epoxy fill used in retrofit applications.

Figure 4B:
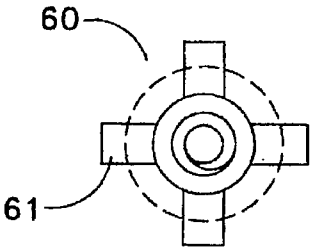
FIG. 4(*a*) is a side elevational view of a first embodiment of a stud engagement member for use in the present invention.
Figure 4A:
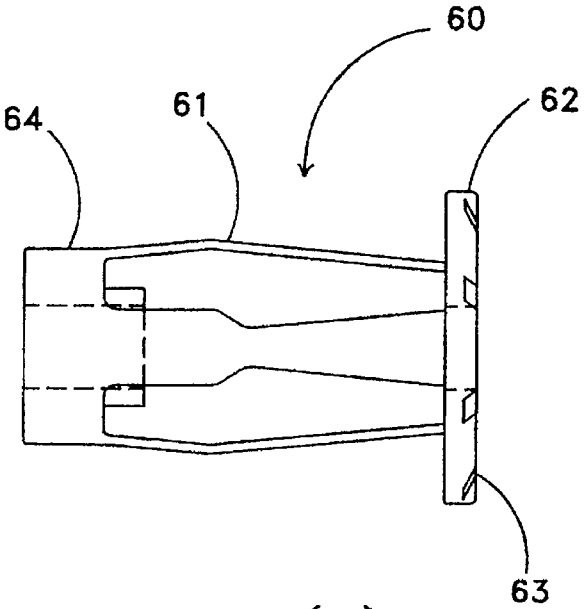

Following the boring of the appropriate holes, a stud engagement member 60, as shown in detail in FIG. 4(*a*), is engaged to the stud. The engagement member is provided with second and first clamp members, respectively, that comprise interior and exterior members that clamp the front plate 14 therebetween to serve as a rigid anchor for the rod. It will be understood that the terms "interior" and "exterior", as well as "inwardly" and "outwardly", refer to the interior and exterior of the building. The engagement member may comprise a blind fastener such as a Molly Nut (Tm.). A typical blind fastener, as illustrated herein, is a slotted collapsible tubular member 61. The tubular member is fastened at its exterior end to a washer 62, and at its interior end it merges with an integral nut 64.

The fastener 60 may be partly inserted, when in the uncollapsed configuration shown in FIG. 4(*a*), through hole 52, with the washer 62 remaining outside the hole 52. The fastener is then collapsed axially to clampingly engage the stud plate, through the use of a fastener engagement wrench 70, shown in FIG. 7 and described below. Collapsing of the fastener is effected by inserting the wrench through the interior of the fastener to screw-threadedly engage the nut 64 at the rear face of the fastener. Rotation of the wrench handle causes the nut to be drawn forwards, towards the washer 62, causing the fastener to collapse axially and the walls 61 to expand radially outward. As the tubular member 61 is collapsed and drawn forward, it splays outwardly and engages the rear of the front plate 14, as shown in FIG. 4(*b*). The front plate 14 becomes clamped between the tubular member 61 and the washer 62. An array of teeth 63 extend rearwardly from the washer 62, and serve to grip the front plate 14 of the stud. The collapsed tubular member 61 also serves as a flange to stiffen the face plate 14, to provide additional strength to the connection between the tie and the stud. The tool may be then removed, and the rod 20 threaded into the nut 64 of the stud engagement member 60. Rotation of the rod may be effected by turning the fixed nut 41, through the use of a socket wrench having a head sufficiently long to extend into the hole 48 within the mortar. The extent to which the rod 20 is permitted to travel through the stud engagement member 60 is limited by the position of the fixed nut 41 on the rod.

Figure 5:
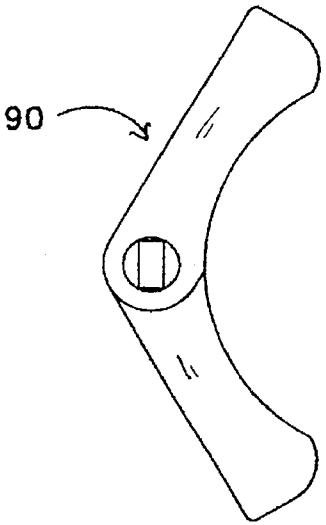
FIG. 5 is a side elevational view of a second embodiment of a stud engagement member.

An alternative stud engagement member is shown in FIG. 5. In this alternative, the interior member comprises toggle 90, having two wings 92 pivotally engaged to a body 94. The rod 20 is screw-threadedly engaged to the body, with the wings being folded inwardly to allow for insertion into the hole 52. Rotation of the rod draws the body forwardly, splaying the wings outwardly to engage the rear face of the front plate 14. The exterior member may comprise a washer, not shown, that cooperates with the toggle to clamp the front plate 14 when the toggle is drawn forwardly.

Following engagement of the engagement member to the font plate 14, continued rotation of the rod causes the rotatable nut 34 and the washer 36 to be drawn towards the fixed nut 41, causing the exterior sleeve 46 of the sealing member 38 to compress axially and expand radially outwards. Axial compression of the outer sleeve is limited by the rigid inner sleeve 44. The outward expansion of the exterior sleeve 46 causes it to sealingly engage the sheathing, to limit seepage of moisture through the hole 52. The dimensions of the inner and outer sleeves, and the amount of compression applied thereto, are selected to cause the outer sleeve to splay outwardly to a degree sufficient to seal the hole 52 from against the entry of moisture and air, but to avoid delamination or other damage to the sheathing. A portion of the exterior sleeve 46 remains on the outside of the hole 52, to form an external seal 47 around the rim of the hole 52, as seen in FIG. 3(*b*). The fixed nut serves as a stop member to limit the travel of the various components along the rod, and to allow axial compression of the sealing member.

The nuts and washers may be fabricated from galvanized steel, stainless steel, or other corrosion resistant material.

Following installation of the device onto the support wall in retrofit applications, the masonry veneer is engaged to the rod by means of an epoxy gel 66 or other like cement, injected into the hole 48. The gel 66, when hardened, cements the rod to the surrounding masonry and mortar. The hole may be capped by a mortar patch 68.

Figure 7:
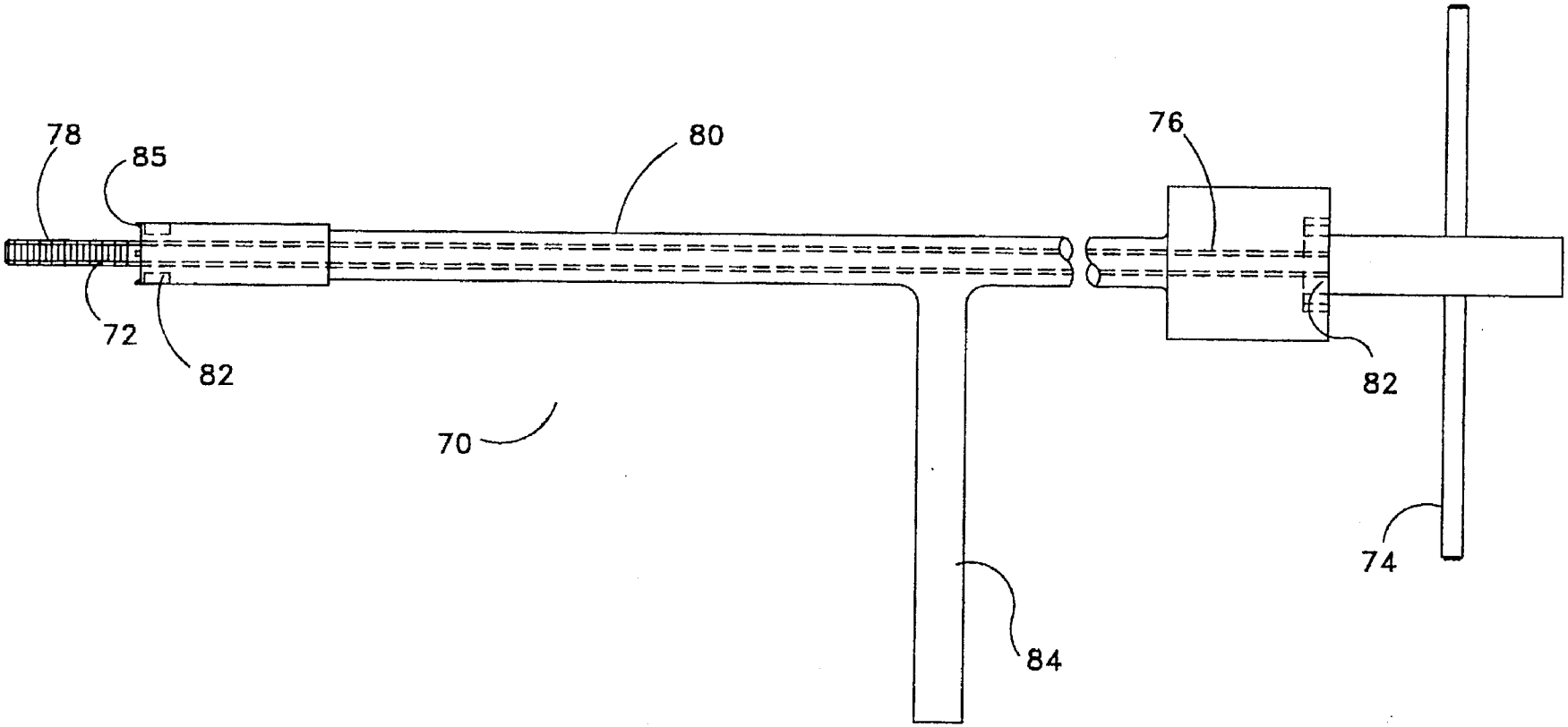
FIG. 7 is a side elevational view, partly in section, of a blind fastener engagement wrench adapted for use with the present invention.

The blind fastener engagement wrench 70, illustrated at FIG. 7, has a threaded shaft 72 extending the length of the device, with a handle 74 at a first end 76 thereof. The second end 78 of the shaft is adapted to be threaded into the nut and washer combination 64 of the stud grip 60. The shaft is rotatably mounted within a tubular housing 80, and is suspended therein by bushings 82. The housing 80 has a sufficiently narrow diameter to allow it to be inserted through the holes 50 and 52, but sufficiently wide to allow an end thereof to abut the stud plate 14 at the hole 48. A pair of hand grips 84 extend outwardly from the housing 80, to allow the user to grip the device. An array of hardened steel teeth 85 extends from the rear rim of the housing, for gripping the exposed front face of the engagement member as it is being engaged to the stud, to prevent the fastener from rotating as the handle 74 is turned. The wrench is operated by initially threading the exposed end of the shaft 72 through the stud engagement member 60, in the uncollapsed configuration. The shaft and housing, with the engagement member engaged to the shaft, are inserted through the holes 48 and 50, with the engagement member being further partly inserted through the hole 52. The exterior member of the engagement member remains outside the hole 52, to abut the stud. The shaft 72 is then rotated, with the user gripping for this purpose the handle and grips 74, 84, causing the housing 80 to be drawn towards the stud plate 14. Continued rotation of the handle causes the interior member of the stud engagement member to collapse, and the engagement member to clampingly engage the stud face plate 14.

It will be understood that although the present invention has been described by way of a preferred embodiment thereof, modifications may be made thereto without departing from the spirit and scope of the invention, as defined by the appended claims.

I claim:

1. A tie for engaging a masonry veneer to an underlying support wall for the fabrication of a building wall; said support wall comprising a sheathing backed by an array of metal studs; said tie adapted to extend through an aperture extending through said sheathing and an underlying stud and comprising a wall engagement member engageable to a threaded rod, said wall engagement member comprising first and second clamp members having threads mating with said rod to permit said members to be screwed together, said clamp members being positionable on inside and outside faces, respectively, of said support wall to clampingly engage said support wall therebetween when said first clamp member is drawn towards said second clamp member; said first clamp member comprising a washer means; said second clamp member incorporating expansion means to expand from a closed position whereby said second clamp member and a portion of said rod may be inserted through said aperture from the exterior of said support wall, and to expand radially outwardly to an open position upon clamping engagement of said support wall to prevent withdrawal of said tie from said aperture, and teeth means to prevent the rotation of said clamp member relative to the wall while said clamp members are drawn together.

2. A tie as claimed in claim 1, wherein said second clamp member has an elongate generally tubular body, a first end facing said inside face when positioned within said support wall and a second opposing end, the walls of said body adapted to radiate outwardly to abut the inside face of the stud when said first and second ends are drawn towards each other to comprise said expansion and antirotation means.

3. A tie as claimed in claim 1, wherein there is further provided a sealing member comprising a resilient sleeve encircling said rod positioned between said first and second clamp members, said sleeve expanding radially outward when compressed axially and adapted to be positioned within an aperture within said sheathing and to sealingly engage said aperture to limit the entry of moisture through said building wall.

4. A tie as claimed in claim 3, wherein said sealing member further includes a rigid tube positioned within the interior of said resilient sleeve and encircling said rod, said rigid tube serving to limit the axial compression of said resilient sleeve.

5. A tie as claimed in claim 3, wherein a portion of said resilient sleeve remains outside of said aperture when the sleeve is axially compressed, to comprise a seal external to said aperture.

6. A tie as claimed in claim 3, wherein said resilient sleeve is adapted to be positioned within an aperture within said sheathing.

7. A tie as claimed in claim 1, wherein there is further provided a wrench engagement member fixedly engaged to the rod to allow a wrench or other tool to grip and rotate said rod.

8. A tie as claimed in claim 7 wherein said wrench engagement member further comprises a stop member to permit the axial compression of said sealing member.

* * * * *